United States Patent [19]

Oderbolz et al.

[11] 4,112,983

[45] Sep. 12, 1978

[54] PICKING BANDS AND DRIVE ARRANGEMENT FOR GRIPPER WEAVING MACHINE

[75] Inventors: Fredy Oderbolz, Tann-Ruti; Paul Bebie, Wolfhausen, both of Switzerland

[73] Assignee: Ruti Machinery Works Ltd, Ruti, ZH, Switzerland

[21] Appl. No.: 810,855

[22] Filed: Jun. 28, 1977

[30] Foreign Application Priority Data

Jul. 8, 1976 [CH] Switzerland ..... 8741/76

[51] Int. Cl.[2] ..... D03D 47/18

[52] U.S. Cl. ..... 139/446; 139/449

[58] Field of Search ..... 139/440, 441, 443, 444, 139/445, 446, 449, 92; 428/367, 902

[56] References Cited

U.S. PATENT DOCUMENTS

| | | | |
|---|---|---|---|
| 3,669,566 | 6/1972 | Bourquardez et al. | 428/902 |
| 3,754,577 | 8/1973 | Heller | 139/92 |
| 3,874,420 | 4/1975 | Cugini | 139/447 |
| 3,902,732 | 9/1975 | Fosha et al. | 428/902 |
| 3,981,332 | 9/1976 | Schwarz | 139/449 |
| 4,023,801 | 5/1977 | Van Auken | 428/902 |
| 4,044,802 | 8/1977 | Steverlynck | 139/449 |

FOREIGN PATENT DOCUMENTS

| | | | |
|---|---|---|---|
| 2,030,433 | 12/1971 | Fed. Rep. of Germany | 139/449 |

*Primary Examiner*—Henry S. Jaudon
*Attorney, Agent, or Firm*—Donald D. Denton

[57] ABSTRACT

A gripper weaving machine having flexible weft inserting or picking bands formed from plastics material reinforced with carbon fibers.

5 Claims, 4 Drawing Figures

PICKING BANDS AND DRIVE ARRANGEMENT FOR GRIPPER WEAVING MACHINE

BACKGROUND OF THE INVENTION

The invention relates to a gripper weaving machine having a flexible weft inserting or picking band, said picking band being secured at its one end to a driving wheel capable of being driven in an oscillatory fashion and having a gripper head secured to the other end of said picking band for the purpose of inserting weft threads into a shed.

Known picking bands of this kind are made from tempered steel and are naturally relatively heavy and rigid. This rigidity gradually decreases with the duration of time due to the stress that the bands are subjected to during their continual oscillatory movement during weaving. Also, the bands become heated to a relatively considerable extent during operation which also contributes to the reduction in rigidity.

To obviate the heating of steel bands, it has been proposed to replace such bands by bands made of conventional plastics materials; but these bands have not been successfully adopted in actual practice since they have much too little rigidity as compared with steel bands.

The closest prior art known to the applicants in connection with this application is in U.S. Pat. No. 2,604,123.

SUMMARY OF THE INVENTION

The invention contemplates providing a picking band or element which does not have the aforesaid disadvantages, that is, the bands have considerably less specific gravity than known picking elements made of steel and in addition have a greater modulus of elasticity and do not become heated during the weaving operation.

This object of the invention is achieved by forming the picking band of a plastics material reinforced with carbon fibers.

BRIEF DESCRIPTION OF THE DRAWINGS

These and other objects will become apparent from the detailed discussion of a preferred embodiment with reference to a constructional example and the drawings, in which.

DESCRIPTION OF PREFERRED EMBODIMENT

Figure 1:
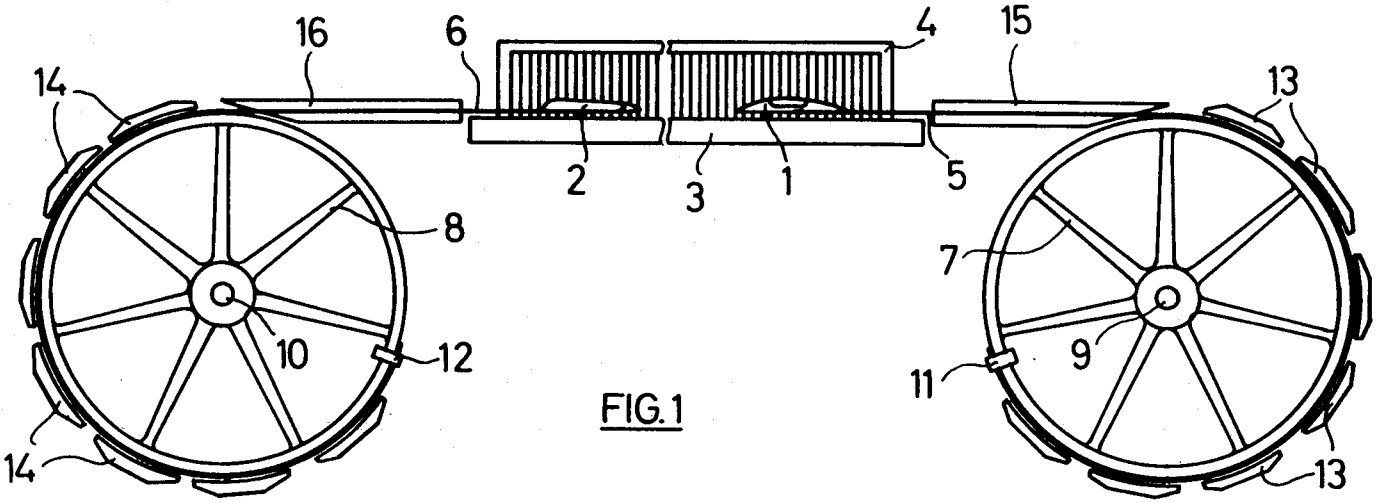
FIG. 1 shows a diagrammatic front view of those parts of a band gripper weaving machine which are necessary for the understanding of the invention.

FIG. 1 shows a diagrammatic fragmentary view from a band gripper weaving machine of known type, wherein the weft threads are arranged in the form of a large supply laterally of the weaving machine and are supplied to a first picking head 1. The first picking head 1 engages the weft thread outside the shed, which is not shown, and transports it to the middle of the shed where it transfers the said weft thread to a second picking head 2. The second picking head 2 carries the weft thread from the middle of the shed through the second half of the shed and releases the weft thread after issuing from the shed, thus completing a thread insertion into the shed of the weaving machine. Then the weft thread is beaten up by means of a reed 4 secured on a slay 3.

The two picking heads 1 and 2 carry out a forwards and backwards movement in opposite directions and are each mounted on one end of a flexible picking band 5, 6. The other end of each band is connected securely to a driving wheel 7, 8 by means of a clamping connection 11, 12. Each driving wheel is mounted to be capable of rotating on a shaft 9, 10 and can be driven in oscillatory manner about its axis. It will be appreciated that shaft 9, 10 is operatively connected to the main driving means of the weaving machine and thus performs its turning operation so as to synchronize the movement of the gripper heads into the shed of the weaving machine at the proper time when thread insertion is called for to produce the weaving of the product being formed on the weaving machine. The picking bands 5, 6 are wound onto their driving wheel 7, 8 respectively and unwound from the driving wheel in oscillatory movement to produce a weft thread insertion. When the picking bands 5, 6 are unwound, the driving wheel 7 moves in the counterclockwise direction and the driving wheel 8 in the clockwise direction.

Because of the secure clamping connection 11, 12 between each driving wheel 7, 8 and its picking band 5, 6, the latter is pushed when the band is unwound and pulled when the band is wound-on. The pushing action when the picking bands 5, 6 are unwound presses the said bands outwards away from the circumference of their driving wheel 7, 8 and they slide on curved guide elements 13, 14 arranged in stationary manner along a portion of the circumference of the driving wheels. Further straight band guides 15 and 16 are situated between each driving wheel 7, 8 and the weaving shed to produce the straight movement of the picking heads 1, 2 as they oscillate back and forth through the shed of the weaving machine.

The picking bands 5 and 6 are made of a plastics material, for example an epoxy or phenol composition, reinforced with carbon fibers. It will also be appreciated that other plastic compositions may be used that are reinforced with carbon fibers and exhibit good rigidity and toughness during continued weaving operations as well as resistance to heating.

The picking heads 1 and 2 are secured to their respective picking bands 5, 6 by an adhesive and the clamping connection 11, 12 for attaching the other ends of each of the picking bands 5, 6 to each driving wheel 7, 8, respectively.

Figure 4:
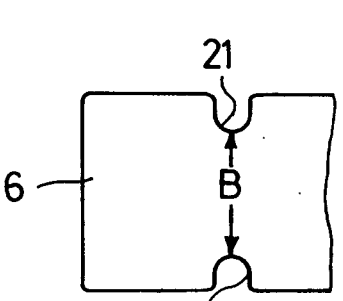
FIG. 4 shows a plan view of the clamping end of a picking band.
Figure 3:
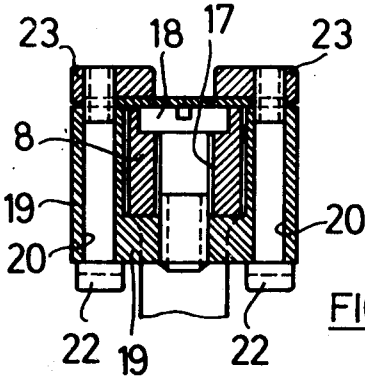
FIG. 3 shows a sectional view taken on the line III—III of FIG. 2.
Figure 2:
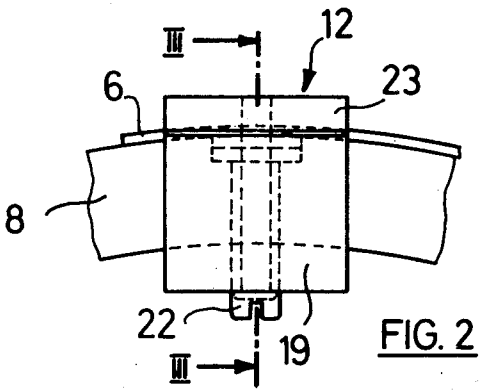
FIG. 2 shows a partial vertical front view of a band end clamping connection shown in FIG. 1.

In FIGS. 2 to 4, the clamping connection 12 which secures the picking band 6 to the driving wheel 8 is shown in detail. The clamping connection 11 is identical to the clamping connection 12 shown in these figures except for the laterally inverted position of the picking band 5.

As shown in FIGS. 2 to 4, the rim of the driving wheel 8 is provided with a radial bore 17. The radial bore 17 is used for receiving a securing screw 18 by means of which a clamping element 19 fitted from the inside over the web and the two flanks of the wheel rim is secured to the wheel rim. The clamping element 19 has a U-shaped cross-section having a flat bottom and two spaced side walls and is provided with a bore 20 in each of its two side walls. The bores 20 are situated parallel to the radial bore 17 and in the same plane as the latter bore.

The picking band 6 is provided in the region of its end which is to be clamped in position, with two opposite slot-like recesses 21 in its longitudinal edges. The width B of the band 6 at the region of the recesses 21 is somewhat smaller than the inter-axis spacing of the two bores 20 minus the diameter of a bore 20.

To clamp the picking band 6 in position securely, the said band is placed with its free end on the rim of the driving wheel 8 and the two recesses 21 are brought into register with the bores 20.

Then a screw 22 is pushed through each of the bores 20 from the direction of shaft 10 and screwed to a mating clamping jaw 23 in each case which clamps the picking band 6 securely from the outside. The surface of the clamping jaws 23 which is pressed against the picking band 6 has an arcuate outline or surface, the radius of this arc being as large as or preferably somewhat smaller than the spacing from the center axis of the shaft 10 to that outer surface of the picking band 6 which is remote from the driving wheel 8. In this way the picking band 6 is either clamped securely over the entire length of the clamping jaws 23 in a uniform manner or preferably more strongly at the ends of the clamping jaws than in the middle of the jaws.

The width of the clamping jaws 23 is so selected that on the one hand there is an adequately large clamping surface available and on the other hand the guide elements 14 can extend through freely so that guide elements can resist any tendency for the picking band 6 to move away from the surface of the band wheel during its travel into the shed.

What is claimed is:

1. A gripper weaving machine having flexible weft picking bands for inserting weft threads into a weaving shed, each of said picking bands being secured at one end to a driving wheel positioned on a drive shaft capable of being driven in an oscillating manner during the operation of the weaving machine and having a gripper head secured to the other end of said picking band, the said picking bands being formed from a plastics material reinforced with carbon fibers so as to maintain the required flexibility and strength of the plastic bands during their continual oscillating in the weaving operation.

2. The gripper weaving machine according to claim 1 in which the plastics material is an epoxy composition.

3. The gripper weaving machine according to claim 1 in which the plastics material is a phenol composition.

4. The gripper weaving machine according to claim 3 in which each reinforced plastic picking band is secured to said driving wheel by a clamping connection which has a clamping element which is fitted from the inside over the rim of the driving wheel and is secured by screw connection to the wheel rim by two clamping jaws having clamping surfaces which are clamped from the outside of the driving wheel against the clamping element, the picking band being held between the outer circumferential surface of the driving wheel and the clamping surface of the clamping jaws.

5. The gripper weaving machine according to claim 4 in which the clamping surface of each clamping jaw is an arcuate surface and the radius of the arc generating said surface is not greater than the spacing from the center axis of the driving shaft to the surface of the reinforced plastic picking band remote from the driving wheel.

* * * * *